US010160233B2

(12) United States Patent
Jensen et al.

(10) Patent No.: US 10,160,233 B2
(45) Date of Patent: Dec. 25, 2018

(54) PRINTER HAVING GUIDE FOR GUIDING PRINT MEDIA AROUND CURVED MEDIA PATH

(71) Applicant: MEMJET TECHNOLOGY LTD., Dublin (IE)

(72) Inventors: David Jensen, North Ryde (AU); Paul Mackey, North Ryde (AU); Saminda Jayatileke, North Ryde (AU)

(73) Assignee: MEMJET TECHNOLOGY LIMITED (IE)

( * ) Notice: Subject to any disclaimer, the term of this patent is extended or adjusted under 35 U.S.C. 154(b) by 0 days.

(21) Appl. No.: 15/438,658

(22) Filed: Feb. 21, 2017

(65) Prior Publication Data

US 2017/0173978 A1 Jun. 22, 2017

Related U.S. Application Data

(63) Continuation of application No. 14/732,430, filed on Jun. 5, 2015, now abandoned, which is a continuation of application No. 13/933,391, filed on Jul. 2, 2013, now Pat. No. 9,102,172.

(60) Provisional application No. 61/668,287, filed on Jul. 5, 2012.

(51) Int. Cl.

| | |
|---|---|
| ***B41J 11/00*** | (2006.01) |
| ***B41J 3/60*** | (2006.01) |
| *B41J 13/00* | (2006.01) |

(52) U.S. Cl.

CPC ..... *B41J 11/0045* (2013.01); *B41J 3/60* (2013.01); *B41J 11/006* (2013.01); *B41J 13/009* (2013.01)

(58) Field of Classification Search

CPC ..... B41J 11/0045; B41J 3/60; B41J 11/006; B41J 13/009; B41J 17/14

See application file for complete search history.

(56) References Cited

U.S. PATENT DOCUMENTS

| | | | | |
|---|---|---|---|---|
| 7,918,449 B2 * | 4/2011 | Sugiyama | ..... | B41J 3/60 271/186 |
| 2009/0067896 A1 * | 3/2009 | Katayama | ..... | B65H 5/021 399/313 |

* cited by examiner

*Primary Examiner* — Henok Legesse
(74) *Attorney, Agent, or Firm* — Cooley LLP

(57) ABSTRACT

A printer having a beltless guide for guiding print media around a curved media feed path. The guide includes: first and second opposed guide surfaces for guiding print media therebetween; and a chicane corresponding to a point of inflection in the curved media feed path. The media path does not follow a curvature of the chicane and the chicane is configured to transfer print media from contact with the second surface to contact with the first surface or vice versa.

4 Claims, 3 Drawing Sheets

PRINTER HAVING GUIDE FOR GUIDING PRINT MEDIA AROUND CURVED MEDIA PATH

CROSS-REFERENCE TO RELATED APPLICATIONS

The present application is a continuation of U.S. application Ser. No. 14/732,430, filed Jun. 5, 2015, which is a continuation of U.S. application Ser. No. 13/933,391, filed Jul. 2, 2013, which claims priority from Provisional Application Ser. No. 61/668,287, filed Jul. 5, 2012, the entire contents of which are herein incorporated by reference.

FIELD OF THE INVENTION

This invention relates to a duplexing printer for printing double-sided pages. It has been developed primarily for providing high-speed duplexing with minimal reduction in printing speed compared to simplex printing.

BACKGROUND OF THE INVENTION

The Applicant has developed a range of Memjet® inkjet printers as described in, for example, WO2011/143700, WO2011/143699 and WO2009/089567, the contents of which are herein incorporated by reference. Memjet® printers employ a stationary pagewidth printhead offering the advantages of high-speed printing and noise reduction compared to conventional scanning inkjet printers.

To date, the commercially-available range of Memjet® printers provide simplex (i.e. single-sided) printing. Typically, paper is fed from a paper tray, around a C-chute, past the printhead, and delivered to an output tray positioned above the paper tray. The C-chute enables the output tray to be positioned above the paper tray, which reduces the overall footprint of the printer. It would be desirable to provide high-speed duplexed printers based on the Memjet® technology.

One conventional approach to duplexed inkjet printing is described in U.S. Pat. No. 6,018,640. In this type of duplexer, paper is fed past the printhead which prints onto a first side of the paper and then stops. Once the paper has stopped, it is reversed back past the printhead and around a duplexing unit, which may be a removable module of the printer. The duplexing unit typically feeds the paper around a drum such that an opposite second side of the paper is presented in its next pass of the printhead. Notably, this type of conventional duplexer feeds paper past the printhead from the same side of the printhead when printing the first and second sides.

A disadvantage of conventional duplexers, such as the duplexer described in U.S. Pat. No. 6,018,640, is that duplex-printed pages are inevitably printed at slower speeds (typically about half the speed) of simplex-printed pages. Furthermore, the duplexer has a complex media feed path which may result in paper jams. Moreover, the duplexing unit requires drive rollers that operate in two directions and is relatively noisy.

Other approaches to duplexed printing require two printheads. For example, Silverbrook's WO00/65679 describes a duplex printer having a pair of opposed pagewidth printheads. This increases the cost of the printer and, moreover, requires complex printhead maintenance systems. Alternatively, Silverbrook's WO2011/020152 describes a duplex web printer having a serpentine media feed path and two printheads positioned along the serpentine path. This arrangement has a relatively large footprint and is generally unsuitable for office printing.

It would be desirable to provide an inkjet printer, which provides duplexing with little or no speed reduction compared to simplex printing; does not require two printheads; has a smooth operation that is not prone to paper jams; and does not require complex or noisy feed mechanisms.

SUMMARY OF THE INVENTION

In a first aspect, there is provided a printer comprising:

a stationary inkjet printhead;

a media feed path for guiding print media twice past the printhead; and a feed mechanism for feeding print media unidirectionally through the media feed path at a constant speed, wherein the media feed path comprises:

a first section configured for feeding print media past the printhead from a first side of the printhead in a first direction with respect to the printhead;

a second section downstream of the first section, the second section being configured for guiding print media around a single loop, the loop being positioned at a second side of the printhead opposite the first side; and a third section downstream of the second section, the third section being configured for feeding print media past the printhead from the second side of the printhead in an opposite second direction with respect to the printhead, and wherein a point of intersection of the loop is opposite the printhead.

A key advantage of the printer described above is that duplex printing can be performed with no cost in speed. In other words, from the user's perspective, simplex printing and duplex printing are performed at the same speed, because the print media follow the same media feed path irrespective of whether the printer is performing simplex or duplex printing.

Another advantage of the printer described above is that there is only one printhead. This obviously reduces the cost of the printer.

Another advantage of the printer described above is that the feed mechanism feeds print media unidirectionally at a continuous, constant speed. Accordingly, there is no need for any reversing drive motors which are required in most duplexers.

Another advantage of the printer described above is that the loop performs the same function as a C-chute in a conventional simplex printer, enabling a media output tray to be positioned at the same side of the printhead as a media input tray. This maintains a minimal overall footprint for the printer. Typically, the media output tray is positioned directly above the media input tray or vice versa.

Optionally, the media feed mechanism comprises a first drive roller positioned at the first side of the printhead, the first drive roller being engaged with first and second idler rollers, wherein a first nip is defined between the first drive roller and the first idler roller, and a second nip is defined between the first drive roller and the second idler roller.

During use, the print medium is engaged in the first nip when positioned upstream of the first section and the print medium is engaged in the second nip when positioned downstream of the third section. Generally, the first idler roller is positioned below the first drive roller and the second idler roller is positioned above the first drive roller.

Optionally, the media feed mechanism comprises a second drive roller positioned at the second side of the printhead, the second drive roller being engaged with third and fourth idler rollers, wherein a third nip is defined between the second drive roller and the third idler roller, and a fourth nip is defined between the second drive roller and the fourth idler roller. Generally, the third idler roller is positioned above the second drive roller and the fourth idler roller is positioned below the second drive roller.

By positioning the idler rollers above and below the drive rollers in this manner, the engagement forces between the idler rollers and the drive roller largely counter each other, thus lowering the radial loads on the drive roller shaft bearings. This allows higher bearing speeds.

Moreover, the dual use of each drive roller, with its respective pair of upper and lower idler rollers, significantly simplifies the feed mechanism compared to other types of duplexers.

Typically, the second drive roller rotates in an opposite direction to the first drive roller.

The first and second drive rollers are driven by respective drive motors. An advantage of the present invention is that the drive motors are run at a steady speed. This allows lower power motors, higher inertia motors for smoothness, smaller motor drivers and cooler motor running.

During use, the print medium is engaged in the third nip when entering the second section and the print medium is engaged in the fourth nip when exiting the second section.

Optionally, the loop extends from the third nip and loops back to the fourth nip.

Optionally, the loop is shorter than a length of a sheet of print medium, such that, during use, a leading portion of the print medium is gripped in the fourth nip whilst a trailing portion of the print medium is simultaneously gripped in the third nip. For example, for a standard office printer printing A4 (210×297 mm) and US Letter (216×279 mm) sheets of paper, the loop between the third and fourth nips has a length of less than about 279 mm, typically in the range of 220 to 275 mm.

Optionally, the first section feeds print media past the printhead in a generally ascending trajectory with respect to a horizontal plane of the printhead. It has been found that angled trajectories with respect to the printhead are usually preferable for optimal print quality during high-speed pagegwidth printing.

Optionally, the third section feeds print media past the printhead in a generally ascending trajectory with respect to the horizontal plane of the printhead, wherein an angle of trajectory in the first section is opposite an angle of trajectory in the third section.

Optionally, the angle of trajectory in the first and third sections is in the range of 2 to 30 degrees.

Optionally, at least part of the second section is defined by a guide for feeding the print medium around the loop. Typically, the guide has first and second (or inner and outer) guide surfaces. Typically, the first and second guide surfaces are separated from each other by a distance of less than 10 mm or less than 5 mm, around the length of the guide.

Optionally, the guide is configured to provide a curvature in the print media path which is a continuous function having no discontinuities. In mathematical terms, this continuous function means that the second differentiation of the curve varies smoothly i.e. with no step jumps in the curve tangents. With these criteria, it is possible to make a sheet of paper rest against either one of the guide surfaces continuously around the entire looped section of the media feed path once the paper is threaded. Typically, the looped section between the third and fourth nips is absent any rollers.

Optionally, the guide comprises a jink or chicane corresponding to a point of inflection in the curvature of the print medium in the second section. At a point of inflection, the curvature of the print medium (e.g. paper) flips from one side of the paper to the other.

Accordingly, in a second aspect, there is provided a printer having a guide for guiding print media around a curved media feed path, wherein the guide comprises a jink (or chicane) corresponding to a point of inflection in the curved media feed path.

Optionally, the guide comprises first and second guide surfaces and the jink is configured to transfer the print medium from contact with the second guide surface to contact with the first guide surface or vice versa. Accordingly, the print medium gently touches the first or second guide surfaces everywhere except in a gap across the jink. Any resultant drag is typically small and can be overcome by an upstream roller. Typically, the jink obviates the need for any rollers at the point of inflection in the curvature of the media feed path.

Optionally, the jink is configured to allow the print medium to follow a substantially linear path as it transfer from one guide surface to the other. It will be appreciated that a suitable configuration of the jink may be determined by varying the distance of separations between the two guides surfaces and the angle of the jink. Typically, the jink comprises two angular deviations of less than 45 degrees or less than 30 degrees (e.g. 10 to 30 degrees).

Optionally, the first and second guide surfaces are separated from each other by a distance of less than 5 mm or less than 3 mm (e.g. 1 to 4 mm) along the jink. Hence, the distance over which the print medium is unsupported as it transfers from one guide surface to the other is relatively short, thereby minimizing the risk of paper jams.

Optionally, the guide comprises a double-jink configured to provide tangential points of contact for the print medium on respective first and second surfaces of the guide.

BRIEF DESCRIPTION OF THE DRAWINGS

Embodiments of the present invention will now be described by way of example only with reference to the accompanying drawings, in which.

DETAILED DESCRIPTION OF THE INVENTION

Figure 1:
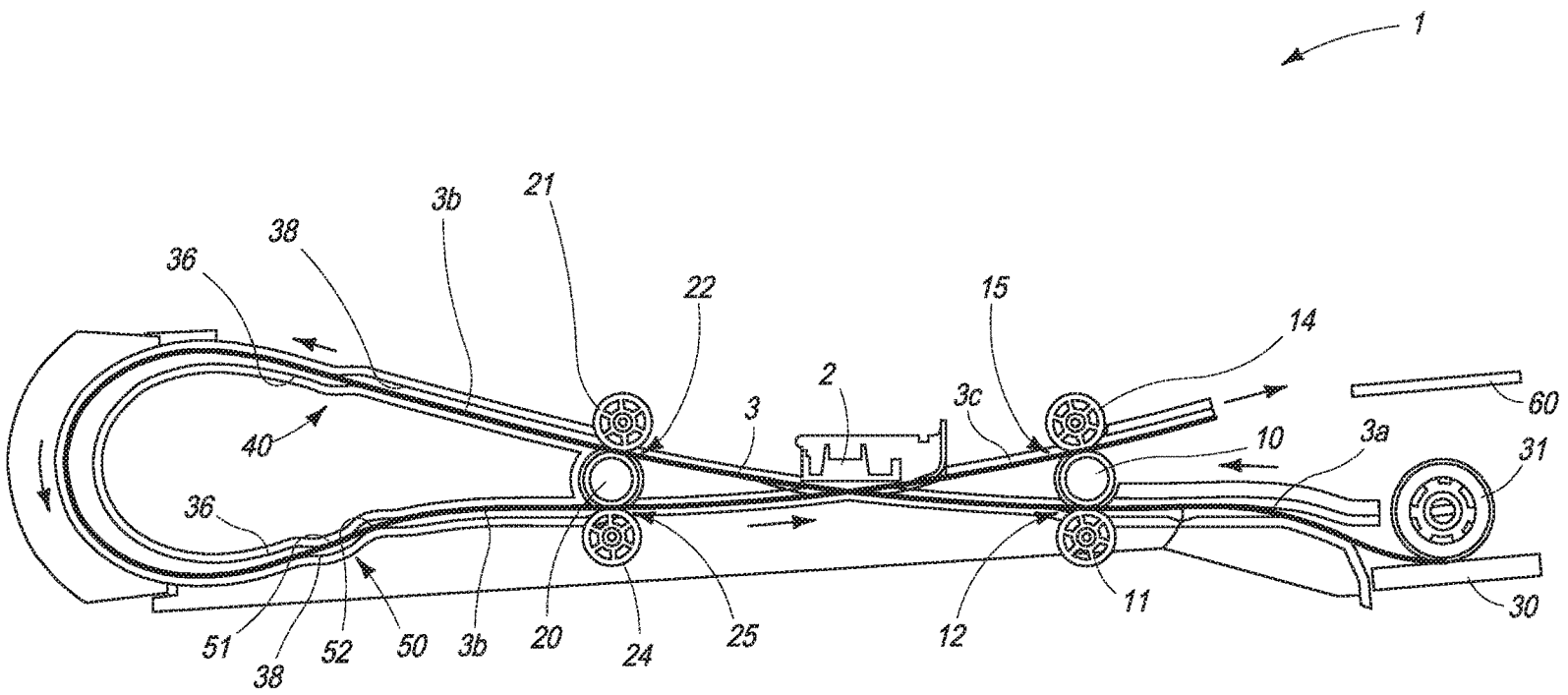
FIG. 1 is a cutaway side view of a printer comprising a media feed path and media feed mechanism according to the present invention.

Referring to FIG. 1, there is shown a printer 1 configured for duplexed printing. The printer 1 comprises a stationary inkjet printhead 2 and a media feed path defined by a "loop-the-loop" or criss-cross path 3. A media feed mechanism comprises a first roller assembly positioned at a right-hand side of the printhead 1 as shown in FIG. 1, and a second roller assembly positioned at a left-hand side of the printhead 1.

The first roller assembly comprises a first drive roller 10 engaged with both a first lower idler roller 11 to define a first nip 12 and a second upper idler roller 14 to define a second nip 15. Likewise, the second roller assembly comprises a second drive roller 20 engaged with both a third upper idler roller 21 to define a third nip 22 and a fourth lower idler roller 24 to define a fourth nip 25.

The media feed path 3 comprises a first section 3*a* for feeding print media past the printhead from an input tray 30 positioned at one side of the printhead. In use, print media are lifted from a stack of sheets in the input tray 30 using a picker 31 and fed into the nip 12 defined between the first drive roller 10 and the first idler roller 11. Rotation of the first drive roller 10, in a clockwise sense as shown in FIG. 1, feeds the print media through the first section 3*a* of the media feed path past the printhead 2. It will be seen from FIG. 1 that the first section 3*a* feeds print media in a generally upwardly ascending trajectory past the printhead 2.

After exiting the first section 3*a*, the print media enter the second section 3*b* of the media feed path. The second section 3*b* guides the print media around a single loop which is positioned at an opposite side of the printhead 2 relative to the media input tray. The second section comprises a guide having an first inner guide surface 36 and a second outer guide surface 38. The second drive roller 20 is used to feed print media around the second section 3*b* and into a third section 3*c* of the media feed path. Specifically, after exiting the first nip 12 and being fed past the printhead 2, print media enter the third nip 22 defined between the third upper idler roller 22 and the second drive roller 20. Rotation of the drive roller 20, in a counterclockwise sense as shown in FIG. 1, feeds the print media around the loop and into the fourth nip 25 defined between the second drive roller 10 and the fourth lower idler roller 24.

The length of the loop between the third and fourth nips 22 and 25 is such that a leading edge of a sheet is gripped in the fourth nip 25 whilst a trailing edge of the sheet is gripped in the third nip 22.

From the fourth nip 25, print media enter the third section 3*c* of the media feed path in which they are fed past the printhead 2 again, but this time in an opposite direction with respect to the printhead. It will be seen from FIG. 1 that the third section 3*c* feeds print media in a generally upwardly ascending trajectory past the printhead 2. This angle of trajectory in the third section 3*c* is typically opposite the angle of trajectory in the first section 3*a*.

Finally, after being fed past the printhead 2 in the third section, the print media enter the second nip 15 defined between the first drive roller 10 and the second idler roller 14, from where they are delivered to a media output tray. Typically, the media output tray 60 is defined by an exterior surface of a printer housing (not shown). The overall footprint of the printer is relatively small by virtue of placing the media output tray 60 above the media input tray 30, and this is made possible by the criss-cross media feed path. The criss-cross media path effectively replaces the C-chute used in conventional simplex printers.

Notably, the print media present an opposite face to the printhead 2 in the second pass (third section 3*c*) compared to the first pass of the printhead (first section 3*a*). This provides the option of duplex printing, although of course the print media follow an identical path for simplex printing. Thus, simplex printing offers no particular advantages in terms of higher speeds, reduced risk of paper jams or reduced noise. This potentially changes users' perceptions of 'normal' printing—that is, duplexing becomes the norm.

Figure 2:
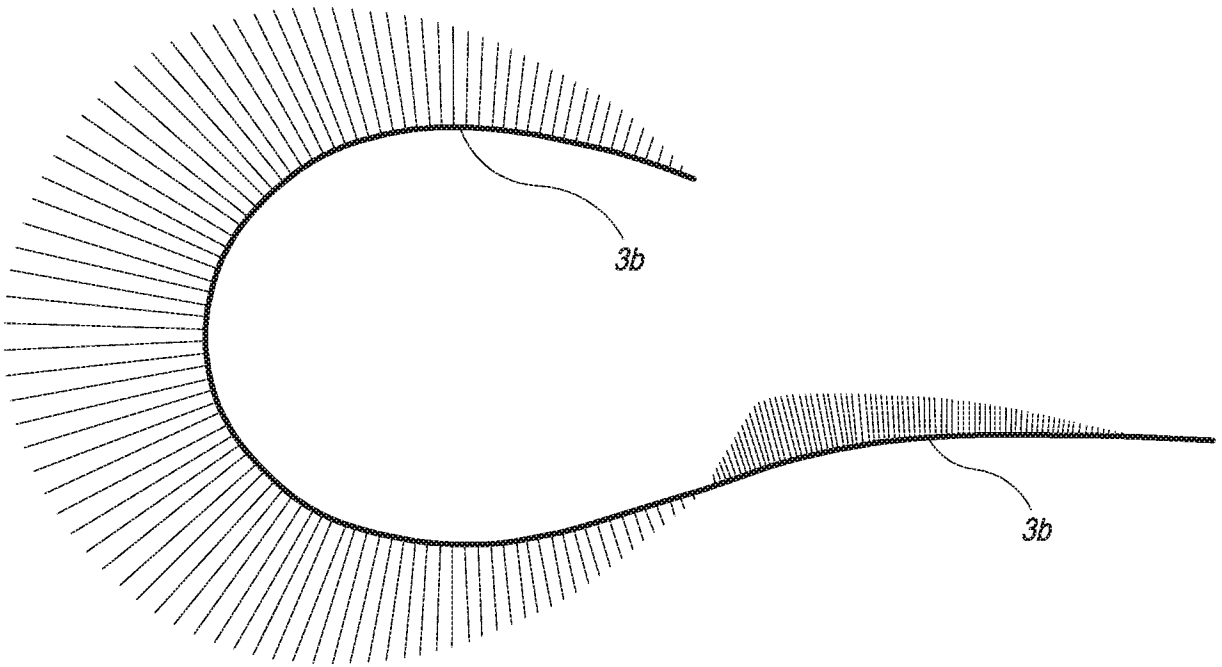
FIG. 2 shows curvature "combs" on a loop section of the media feed path, which includes a point of inflection.

In order to provide a smooth media feed path with reduced noise and risk of paper jams, the guide surfaces in the second section provide a media feed path having curvature with a continuous function. As shown in FIG. 2, there are no step jumps in the curve tangents of the media feed path. With this continuous functions curvature, a print medium can rest against a guide surface at virtually all points, such that the curvature of the guide corresponds to the natural curvature of the print medium.

At certain points in the media feed path, the print medium is required to change its sense of curvature (i.e. from convex to concave or vice versa). At these points of inflection in the curvature of the print medium (and media feed path), one or more jinks are defined in the guide surfaces such that the print medium is handed over from the second outer guide surface 38 to the first inner guide surface 36 or vice versa.

Figure 3:
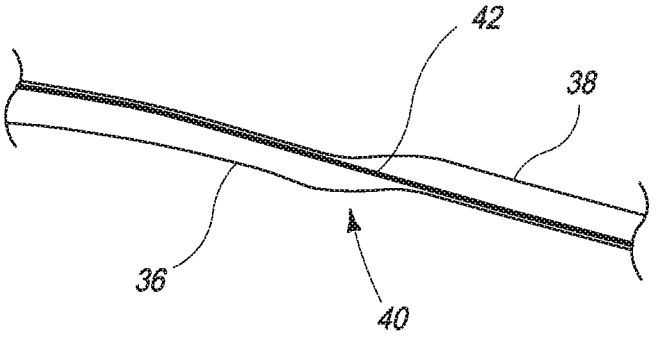
FIG. 3 shows a jink in inner and outer guide surfaces.

FIG. 3 shows part of the guide have an inner guide surface 36 and an outer guide surface 38 with a jink 40 at a point of inflection 42 in the curvature of the media feed path 3. It can be seen from FIG. 3 that the print medium swaps from the inner guide surface 36 to the outer guide surface 38, across a gap between the two guide surfaces. Thus, the print medium gently touches either one of the guide surfaces except across the jink.

In FIG. 1, there is shown a double-jink 50 in the guide surfaces 36 and 38. This double-jink is positioned at another point of inflection in the media feed path 3. It can be seen that the print medium has tangential points of contact 51 and 52 with the inner guide surface 36 and outer guide surface 38 respectively when passing through the double-jink. These tangential points of contact 51 and 52 provide additional support for the print medium at its point of inflection.

It will, of course, be appreciated that the present invention has been described by way of example only and that modifications of detail may be made within the scope of the invention, which is defined in the accompanying claims.

The invention claimed is:

1. A printer having a beltless guide for guiding print media around a curved media path suitable for duplex printing, the guide comprising: first and second opposed guide surfaces for guiding print media therebetween; and at least one chicane corresponding to a point of inflection in the curved media feed path, wherein:

the media path does not follow a curvature of the chicane;

the chicane is configured to transfer, in a gap across the chicane, print media from contact with the second surface to contact with the first surface or vice versa;

the media path is not twisted within the gap about a longitudinal axis oriented in a media feed direction.

2. The printer of claim 1, wherein the guide comprises a double-chicane configured to provide tangential points of contact for print media on respective first and second guide surfaces.

3. The printer of claim 1, wherein the first and second guide surfaces are separated from each other by a distance of less than 5 mm along the chicane.

4. The printer of claim 1, wherein the first and second guide surfaces have corresponding curvatures around the curved media path.

* * * * *